US005109364A

United States Patent [19]

Stiner

[11] Patent Number: 5,109,364

[45] Date of Patent: Apr. 28, 1992

[54] TRANSDUCER FOR HIGH SPEED BOATS

[75] Inventor: Roy E. Stiner, Tulsa, Okla.

[73] Assignee: Lowrance Electronics, Inc., Tulsa, Okla.

[21] Appl. No.: 614,440

[22] Filed: Nov. 16, 1990

[51] Int. Cl.[5] ..... H04R 17/00

[52] U.S. Cl. ..... 367/165; 367/173

[58] Field of Search ..... 367/165, 173, 910, 106, 367/130, 88

[56] References Cited

U.S. PATENT DOCUMENTS

| | | | |
|---|---|---|---|
| 2,672,945 | 3/1954 | Harris et al. | 367/173 |
| 4,850,559 | 7/1989 | Boucher | 367/173 |
| 4,907,208 | 3/1990 | Lowrance et al. | 367/173 |

*Primary Examiner*—J. W. Eldred
*Attorney, Agent, or Firm*—Larson & Taylor

[57] ABSTRACT

A sonar transducer assembly is provided which is adapted to be mounted on the transom of a boat. The assembly includes a shaped transducer device comprising a housing having a base portion of substantially elliptical cross section and a nose of a flattened ellipsoidal shape. A connector stem having a faired leading edge connects the transducer housing to a mounting bracket assembly. The mounting bracket assembly includes a base member adapted to be connected to the transom and a pivotable member which supports the transducer device. A releasable connection between the members includes a pair of laterally spaced, outwardly extending projections on one member which engage ears formed on the other member. An elastomeric insert disposed between the arms controls the force necessary to cause release of the connection to provide "kick-up" when the transducer device strikes an object in the water.

21 Claims, 2 Drawing Sheets

TRANSDUCER FOR HIGH SPEED BOATS

FIELD OF THE INVENTION

The present invention relates to transducers for fishing boats and like craft and, more particularly, to transducers of this type which provide a high quality signal over a range of speeds used by such craft.

BACKGROUND OF THE INVENTION

In typical applications, so-called "add-on," as opposed to "in-hull," transducers are mounted just aft and below the transom of a boat hull for measuring the characteristics of the water or of the boat performance, i.e., characteristics such as water depth, water temperature, speed through the water, and the size and location of marine life, among others. Although the discussion below will center on transducers which provide a display or other read-out of what is taking place under the boat, the invention is not limited to such applications.

Sonar devices, variously referred to as "fish finders" or "depth sounders," have been available for some time which are used to tell a user what is below the boat. Transducers used to transmit acoustical energy (sonar) into, and receive this energy from, the water can either be an integral part of the boat hull (the "through-the-hull" or "in-hull" design) or mounted by means of appropriate brackets to the lower part of the boat transom (the "transom-mount" design). Such "transom-mount" designs are most commonly used by sport fisherman and much of the discussion below is concerned with such designs.

Typically, transducers designed for transom-mounting have plastic or bronze housings simply designed to protect the piezo-electric crystal or crystals of the transducers from water and physical damage. The transducer crystal(s) and the bonding envelope therefor are usually bonded inside the outer housing with a plastic compound to form a continuous "solid" medium through which the acoustical energy waves from the crystal can be transmitted. Typically, a relatively soft material, e.g., cork, is used to envelope the crystal sides and top such that a large acoustical impedance mismatch occurs, causing sound waves to be reflected back into the crystal, while at the same time communication (or reception) of the generated (or reflected) acoustical wave takes place through the transducer structure.

The outside shape of many commercial transducers is typically flat-bottomed with a knife-edge or a like sharp taper being provided at the leading edge for "flow control" over the transducer surface. The transducer is most often mounted below the hull of the boat with a slightly positive angle of attack relative to the oncoming water.

Briefly considering the history of such sonar transducers, one of the earliest sonar transducer devices made by the assignee of this application was a portable low-power unit that a fisherman could carry with him and use on most boats. The output signal presented to the fisherman was a rotating flashing light that represented the presence and/or depth of the fish and bottom. Hence, most models employing this sort of output are generically referred to as "flasher" units.

In those days, the popular way of fishing was to rent a rowboat, possibly with a small outboard motor. Many fishermen had their own small motors but most did not have their own boats and thus a portable sonar unit that could be carried from boat to boat was extremely popular at that time. The sonar device operated off of flashlight batteries and was of very low transmit power. The transducer was a cylindrical unit, flat on the bottom (the bottom end of the cylinder), that housed a 1 inch crystal. No consideration was given to hydrodynamics in the design of the transducer. Such flasher units were used for many years, and units were made that mounted in boat consoles, as well as more advanced portable units.

The next popular type of a transducer was one that was mounted on the transom of the boat with a metal bracket such that the transducer was a "permanent" part of the boat. The transducer had a flat bottom and a rounded or semi-circular nose (in plan view). The transducer would allow the fisherman to read the bottom at speeds to 15 or 20 mph. This transducer also used a 1 inch crystal. Because of the flat bottom with sharp edges, the transducer could not be used at very high speeds. The unit could be bonded inside the hull which provided increase in the operating speed range, dependent upon the mounting location and the flow disturbances underneath the hull.

The next transducer in the evolution being considered had a pointed nose and some effort was directed to providing hydrodynamic streamlining. However, this transducer was again flat-bottomed with a knife edge leading edge and the only way the transducer could be used at speed was with the transducer disposed at a 6 to 8 degree positive (relative to the oncoming water) angle of attack. Speeds up to 40 or 55 mph were possible in this orientation or configuration of the transducer. This unit was designed to be mounted on the transom of the boat, and could be mounted nose forward, or could be turned around "backwards" and mounted with the angled back against the transom of the boat. In this way, the bottom of the transducer could be made flush with the bottom of the boat and thus act as an extension of the boat hull. In this "backward" configuration, the transducer could operate at much higher speeds than with the nose forward. This transducer could also be mounted inside the hull in a "through-the-hull" configuration.

Although the discussion above concerns previous designs of the assignee, most competitive transducer units (including those, for example, made by Humminbird, Airmar Technology Corporation, and Radarsonics Inc.) are similar and, in particular, generally include flat bottoms and knife edges, although some provide minor radiusing or rounding of the leading edges. However, none of these competitive designs can operate at very high speeds unless mounted inside the boat hull or in some cases, mounted as an extension of the hull. Despite the obvious speed advantages of mounting any of the above transducers inside the hull, a major disadvantage is the signal attenuation and resultant loss of power which occurs in attempting to transmit through the thick fiberglass of the hull, because of discontinuities in the hull and because the transducers were not designed to accommodate the thick fiberglass in front of the crystal face.

The last design referred to above was used from the mid 1970s to the present, a roughly 15 year history of use, with little attempt at, or need for, improvement during that period of time. The main reasons for this are that since all transom mount transducers were limited in high speed performance (unless a great deal of experimentation was done to optimize the installation), this was considered to be the "nature of the beast," and there was no real pressure on manufacturers to provide improvement. As boat engine power increased and boat hull designs improved, the available speeds became substantially higher and the speed limitations of the early transducers became evident particularly with respect to transom-mount transducers. As discussed above, transom-mount transducers have the advantages that such transducers can be moved from one boat to another after a fisherman sells or trades his boat and that the transducers generally require less energy to excite them because the acoustical signal does not have to traverse through the thickness of the hull. Som "through-the-hull" transducers do not have the disadvantage associated with transmission through the hull because the transducer is actually molded into the hull on the outside of the hull envelope. These transducers are generally installed at the boat manufacturer or specialized marine shop and, depending on where the transducer is located and how "quiet" the hull is, these transducers can perform quite well at any speed of which the boat is capable. However, such transducers are of specialized application and obviously do not have the advantage of being able to be moved from boat to boat.

Hull "quietness" obviously has an important influence on the effectiveness of a transducer, and generally involves two phenomena, viz., hydrodynamic disturbances and structural excitation. The term hydrodynamic disturbances is used to refer to flow separation (cavitation, bubble generation, and the like) occurring before or at the transducer location that results in the transducer signal being absorbed, reflected, or refracted and, in any event, generally diminished in strength as compared with a transducer immersed in a homogeneous water environment.

The term structural excitation is used to refer to mechanical vibration of the boat hull which can excite the transducer crystal at or near the excitation frequency that the crystal is designed to "listen" for. As most fish-locating transducers are excited well above the range for human hearing (e.g., at 50 kHz, 100 kHz, 192 kHz, 200 kHz, 455 kHz, and so on), only structural excitations in that range will affect the transducer. In general, the higher the rigidity of the boat hull and the mounting assembly which mounts the transducer to the boat hull, the higher the natural frequency of the structural combination, and the greater the possibility of structural feedback. Aluminum hull boats are much more susceptible to such feedback because of the natural frequencies of the hull. The hull frequency is primarily excited by the engine and propeller combination but the hull is also vibrated by the collisions occurring between the hull bottom and waves or wavelets at speed. Transom-mount transducers therefore have an advantage over in-hull transducers in that the structural, i.e., mechanical, attachment to the hull can be designed to minimize the structural feedback path.

In choosing an excitation frequency, a transducer designer must choose between conflicting goals, viz., increased definition at higher frequencies versus increased depth capability at lower frequencies. The lower frequencies often employed for depth are, however, more susceptible to outside acoustical-structural interference. A good mounting system that isolates the crystal from structural influences is obviously important.

Years of experience with older transducer units has shown that, even as installed by a skilled installer, few of these transducers can operate reliably at speeds above 20 mph while being mounted s that the axis of the cylindrically shaped crystal is perpendicular to the surface of the body of water when the boat is traveling at trolling speeds (1 to 3 mph), a mounting orientation which is necessary to provide an undistorted sonar picture of what is directly below the boat (images of fish are characteristically uniform arches on the display screen). The transducers either have to be tuned for operation at trolling speeds (where the transducer has an angle of attack of about negative 2 to 5 degrees relative to the bottom of the hull so as to extend parallel to the water surface) or for operation at speeds above 20 mph (wherein the transducer has a positive angle of attack of up to 15 degrees). Older prior art transducers, because of such factors as the flat-bottomed shape thereof, the necessity to position the transducer below the boat hull, and the excessive positive angle of attack at high speed have been found to exhibit excessive fluid drag and to cause boat control problems (e.g., boat "lift") at higher speeds. Even with considerable adjustment or tinkering, many of the older transducers would not operate reliably above 30 mph.

In recent years, with the increased popularity of high-speed (40 mph and more) fishing boats, it has become desirable to locate fish, and the bottom, reliably at high speeds with a minimum of user installation expertise. Additionally, at these higher speeds, any additional hydrodynamic drag or lift forces (and especially drag or lift forces that are off-centerline) become particularly undesirable with respect to considerations such as power, top speed, and control.

A very serious disadvantage of older transducers is the common lack of hydrodynamic streamlining. Most of such transducers suffer from either a total absence of shaping for this purpose or from what can be worse, shaping that is based on "perceived hydrodynamics," i.e., shaping that is thought to provide a good hydrodynamic response but does not (e.g., transducers having an arrow shape in plan). The large drag and lift coefficients of these prior art devices detrimentally affect both the top speed of the boat and the effective control to be had over the boat during operation. As noted above, such transducers almost universally have a "flat bottom" shape and this leads to separated flows beneath the crystal and thus to severely attenuated signal strength (sometimes referred to as "loss of bottom"). A recent flow-visualization study has shown that such "loss of bottom" occurred at the exact time that separated flow was observed with an underwater video camera at speeds from 1 to 38 mph.

Another disadvantage of older prior art units concerns the mounting brackets for these units. In this regard, the mounting brackets for most older units do not allow for "kick-up" in the event a log or other underwater object is struck, i.e., do not provide for pivoting or other movement of the unit out of the way after being struck by such an object so as to prevent any damage to the unit. It will be appreciated that with a mounting not having such a "kick-up" feature, damage to the transducer unit resulting from such a collision is more likely. Further, most of the transducer mounting designs that do "kick up" are merely bolts with lock washers that permit the transducer to pivot or rotate out of harm's way. The user is then required to stop, perhaps trailer the boat, and properly reposition the transducer. However, the mounting assemblies of some relatively recent transducer models include a stop or abutment against which a portion of the transducer abuts in the lowered position so that the transducer can be returned to the lowered position in the event of "kick-up" occurring. Another disadvantage of some prior art mounting brackets is that the brackets are so stiff that the acoustic signals from the transducer pass harmonic vibrations from the boat hull to the receiving crystal, thereby adding noise to the sonar signal.

U.S. Pat. No. 4,907,208 (Lowrance et al) discloses a sonar transducer assembly which overcomes some of the disadvantages and deficiencies of prior units that were discussed above. The transducer body or housing is generally bullet-shaped and comprises a cylindrical main or base portion and a generally ellipsoidal nose, and includes three transducers inside the housing or body which are aimed in different directions below the boat. Although this transducer unit represents a significant improvement over the prior art with respect to the streamlining provided, the transducer device of the present invention possesses a number of advantages as compared with this unit, as is discussed below.

SUMMARY OF THE INVENTION

In accordance with the invention, a transducer assembly is provided which affords a number of significant advantages over the prior art. One important aspect of the invention concerns the shaping of the transducer or, more particularly, of the housing in which the transducer crystal is contained. More specifically, the housing has a main body portion which is substantially elliptical in transverse cross section (as compared with the cylindrical main body portion of U.S. Pat. No. 4,907,208) and has a "flattened" or widened ellipsoidal nose portion (as compared with the fully rounded ellipsoidal nose portion of that patent). In addition, the mounting means for connecting the transducer housing to the mounting bracket comprises an upwardly projecting fin or "sail" which is rounded o faired at the leading edge thereof and which is disposed in front of, i.e., upstream of, the cable connection to the transducer crystal so as to divert water flowing over the housing away from the cable. This is in contrast to the transducer device of U.S. Pat. No. 4,907,208 wherein the body is supported by a pair of spaced arms of a U-shaped body bracket and the cable is located between these arms so that the arms and the cable all disrupt the flow pattern.

One key advantage of this aspect of the invention is that drag is minimized. Drag is the product of the frontal area, A, and the coefficient of drag, $C_d$, and the invention provides both a small frontal area and a very low coefficient of drag. Regarding the former, a small frontal area is achieved by providing a frontal shape that minimizes the frontal area for the crystal installed. To explain, the transducer crystals commonly used in these transducers are in the shape of short-right circular cylinders and are mounted upright on one flat end so that the frontal projection thereof is a rectangle. The elliptical transverse cross sectional shape of the transducer housing of the present invention is much better matched to this rectangular projection than is the circular cross section of the transducer of U.S. Pat. No. 4,907,308, as explained below and can be appreciated by visualizing a rectangle inside of an ellipse and a rectangle inside of a circle and comparing the space left over around the rectangular in each case.

The transducer of the invention provides improvements over prior art transducer technology with regard to two different mounting techniques, i.e., in two different mounting modes.

First, the transducer of the invention can be mounted so that the bottom of the transducer is either flush with the hull bottom or slightly (e.g. about ¼ inch) below the hull bottom. As the boat travels through the water, pressure is induced into the water traveling across the hull, and when the water passes the stern, a "hydraulic jump" is created due to the relieving of this pressure. Previous transducers would not operate well at speed in this hydraulic jump area. Because of the gradual upsweep of the bottom of the transducer of the invention, water is induced to flow upwards around the body, thereby "wetting" the area under the crystal, and creating a reduced pressure area under the crystal. This prevents premature separation of the water flow which provides an acoustical interface devoid of air bubbles which if present create noise and also act to destroy the acoustical interface). Noise can be defined in this context as being any signal picked up by the transducer and fed back to the sonar device that is not a return echo from the previous sonar transmission.

Second, the transducer can also be mounted immersed in the water so that water flows both under and over the transducer. This deeper mounting is necessary on boat hulls that trap air under them or have numerous protrusions (e.g., rivets on an aluminum hull) that create a layer of air bubbles under the hull. The transducer of the invention is superior to previous constructions in that the water flows smoothly both on top and below the transducer. This creates a low noise environment which gives a cleaner sonar record. The smooth flow across the top is accomplished by the provision of the elliptically faired "sail" as well as the gradually tapering elliptical shape of the transducer nose. The sail also keeps the cable from creating noise as was discussed above. Although the transducer of the invention provides improvement at all frequencies, the transducer of the invention is especially effective at frequencies of 25 to 100 kHz. Prior art transducers were not able to be operated at high speeds due to acoustical noise pickup, while the transducer of the invention has been operated with a 50 kHz crystal at speeds in excess of 60 mph with minimal acoustical noise pickup.

Other advantages of this aspect of the invention include a flow control pattern which avoids flow separation and maintains contact with the water, an ability to operate at faster speeds with a negative angle of attack than prior art units, and the overall small size and short length of the transducer. The latter minimizes the problem of boat lift (and thus of boat control) discussed above, as compared with prior transducers. The speed of the water over the face of the transducer is accelerated as compared with that of the surrounding water. The result is a reduced pressure area, produced by the Bernoulli effect, giving negative lift.

With respect to operation at a negative angle of attack, the transducer of the invention can be mounted with a two to five degree negative angle of attack relative to the water such that symmetrical fish indicating "arches" are maintained at trolling speeds, and yet maintain signal continuity at high speeds. Further, if signal contact with the bottom is lost, e.g., when the boat makes a hard turn and the transducer is lifted clear of the water, contact can be regained by slowing down slightly rather than almost stopping as is required with many prior art transducers.

A second important aspect of the invention concerns the mounting bracket assembly. The mounting bracket assembly provides "kick-up" when the transducer strikes an object in the water while also providing easy resetting of the transducer to the previous position by virtue of a molded construction that eliminates the need for the user to accurately adjust bolt tension (often after removing the boat from the water) as is required with many prior art devices. In this latter regard, the movable part of the mounting bracket and thus the transducer are returned to their original positions by merely snapping the bracket part back in place. Further, the soft (preferably plastic) material used in making the mounting bracket tends to dampen outside acoustical excitations from the boat hull. A further important feature of this aspect of the invention concerns the provision of a removable insert which controls the spring-like holding force that is exerted by the "kick-up" release mechanism and which thus determines the amount of force that must be exerted on the transducer in order to overcome the holding force and thus ensure that "kick-up" occurs. A set of these inserts is preferably provided each of a different durometer (hardness) so that the "kick-up" threshold of the mounting bracket assembly can be varied and controlled by simply substituting a different insert.

Other features and advantages of the invention will be set forth in, or apparent from, the following detailed description of preferred embodiments of the invention.

DESCRIPTION OF THE PREFERRED EMBODIMENTS

Figure 1:
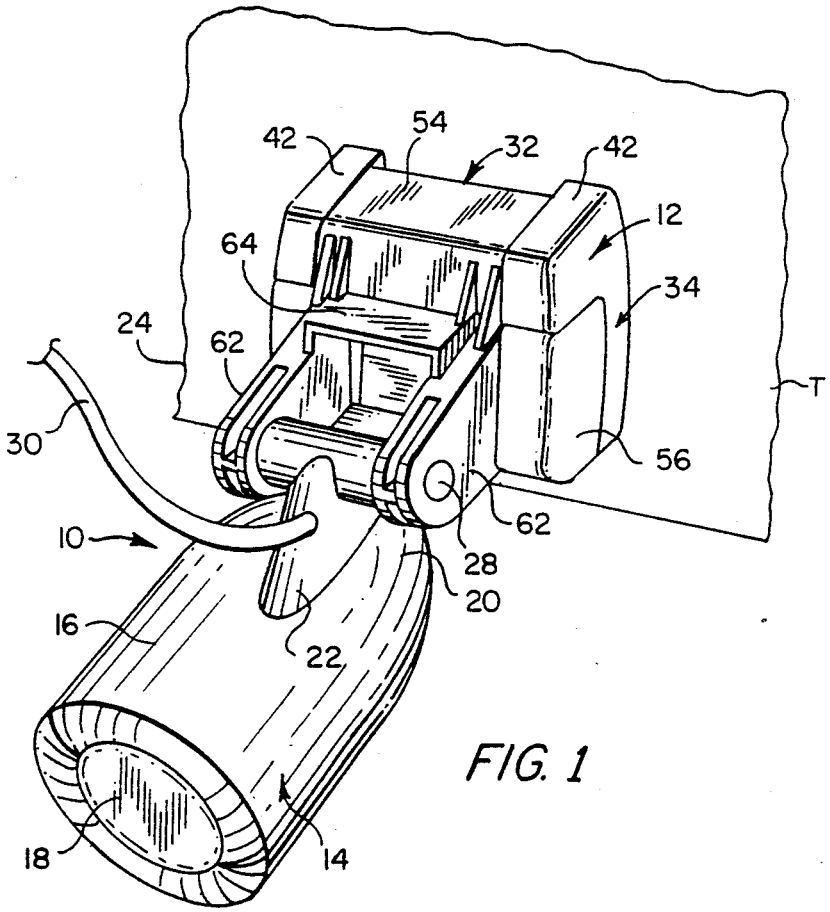
FIG. 1 is a rear perspective view of the transducer assembly of the invention as mounted on the transom of a boat.
Figure 2:
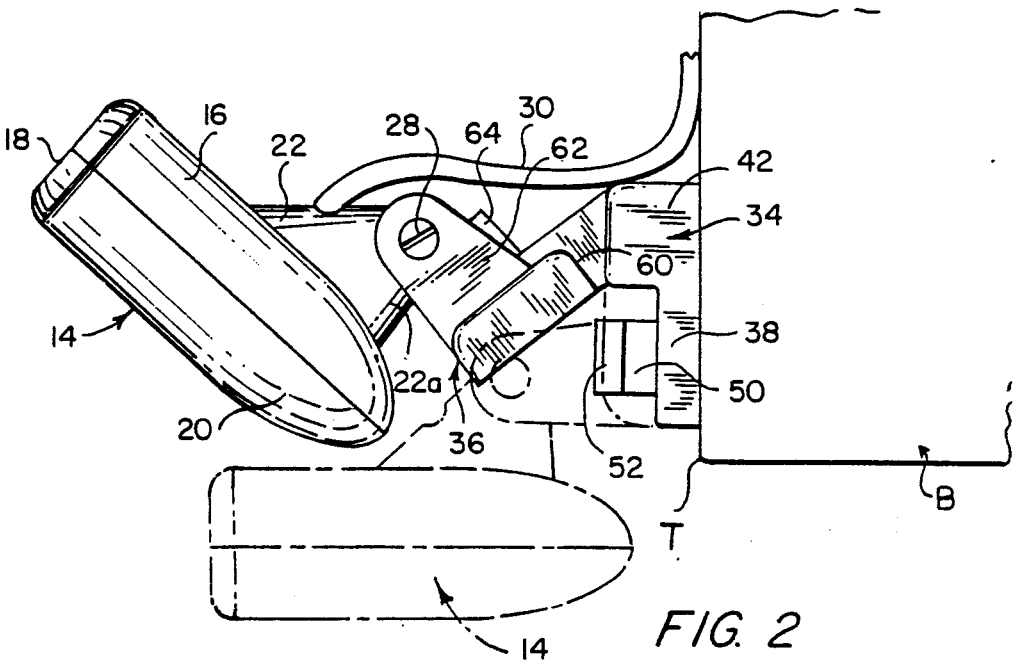
FIG. 2 is a side elevational view of the transducer assembly of FIG. 1 showing the "kick-up" position thereof in solid lines and the normal operating position (corresponding to that shown in FIG. 1) in dashed lines.

Referring to FIGS. 1 and 2, the sonar transducer assembly of the invention is shown mounted on the transom T of a boat B. The transducer assembly, which is generally denoted 10, includes a mounting assembly 12 which is shown in more detail in FIGS. 5 to 7 and which supports a sonar transducer device 14 that is shown in more detail in FIGS. 3, 4 and 8.

Figure 3:
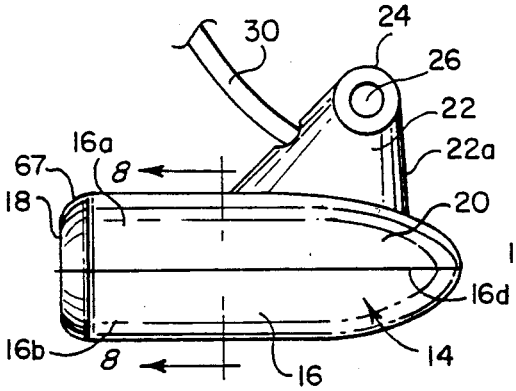
FIGS. 3 and 4 ar side elevational and top plan views, respectively, of the transducer of FIG. 1.
Figure 8:
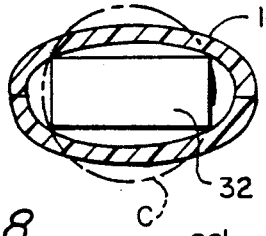
FIG. 8 is a cross sectional view taken generally along line 8—8 of FIG. 3.

Considering transducer device 14 first, and referring to FIGS. 1 to 4 and 8, the device 14 includes a housing 16 having a specialized shape, and was discussed hereinabove, the shape is very important in enabling device 14 to operate effectively at high speeds. As illustrated in FIGS. 1 and 8 the outer surface of housing 16 is generally elliptical in cross section with the trailing or rear end 18 being generally flat as shown in FIGS. 1 to 4 except for a radiused edge 67 and the leading or front end being tapered and rounded to form a nose portion 20 as shown in FIGS. 2 and 3. As illustrated, the shape of the nose portion 20 of housing 16 is generally that of one-half of an ellipsoid. The radiused edge 67 provides a controlled separation point and acts similarly to a "spoiler" of an automobile to reduce drag.

A faired fin-shaped connector or mounting stem 22, also referred to as a "sail," is formed integrally with the top of housing 16 and includes a cylindrical horizontally extending portion 24 having a bore 26 therein through which extends a screw 28 (see FIGS. 1 and 2) used to making connection to mounting assembly 12. The leading edge 22*a* of connector 22 extends generally perpendicular to the longitudinal axis of housing 16 and is elliptically faired, as is perhaps best seen in FIG. 4, in order to improve the flow pattern of the water flowing therepast.

An electrical cord 30, which provides an electrical connection in a conventional manner to a transducer crystal (indicated schematically at 32 in FIG. 8) disposed within housing 16, enters housing 16 through the back or rear of connector 22 and thus, being essentially shielded or blocked by connector 22, provides minimum interference with the water flowing past connector 22 and around and over housing 16. Cord 30 is also connected in a conventional manner to the electronic control unit (not shown) for the overall sonar detection system. It will be understood that the mounting for the crystal 32 and the connections thereto, as well as the overall system ar all conventional and thus will not be described further.

As shown in FIG. 8, transducer crystal 32, which is generally in the shape of a right circular cylinder, is of rectangular shape when viewed head on, i.e., the frontal geometrical projection of transducer 32 is rectangular. As a result, as discussed above, the frontal area of the housing 16 relative the crystal 32 is minimized. This minimization of the frontal area can be appreciated by comparing the area presented by elliptical housing 16 with that presented by a circle C corresponding to a circular housing. It is to be understood that a rectangular housing would, of course, more closely match the projected rectangular shape of the crystal 32 but that the frontal area presented is only one factor in providing a hydrodynamic shape and that a rectangular shape because of the sharp edges thereof would be completely unsuitable at high speeds. The elliptical transverse cross section of transducer housing 16 in combination with the rounded ellipsoidal nose minimizes the frontal area presented to oncoming flow while still providing a smooth flow of water around the bottom of the housing.

As noted above, the housing 16 is, relatively speaking, very small as compared with conventional transducers and when employed with a 1 inch right-circular cylinder crystal (a crystal approximately 0.75 inch in height and 1 inch in diameter), the main housing body 16 (excluding faired connector 22) can be fit inside a box having the internal dimensions of 1.1 inch in height, 1.6 inches in width and 2.7 inches in length. The size of the ellipsoidal nose portion 20 is that of half of an ellipsoid having the dimensions 2.672 inches by 1.573 inches by 1.8 inches, while the cross section of the uniform cross section main body of housing 16 into which nose portion 18 is faired approximates an ellipse having the dimensions 1.573 inches in width by 1.08 inches in height. As noted above, this shaping minimizes the frontal area while still providing clearance for the crystal assembly indicated at 32.

In an exemplary, preferred embodiment, the housing 16 includes, as indicated in FIG. 3, upper and lower parts 16*a* and 16*b*, and the upper portion 16*a* is designed to be injection molded in a two part mold with a seam 16*c* (FIG. 4) running along the upper surface while the lower portion 16*b* is also designed to be injection molded in a two part mold and joined to upper portion 16*a* along a seam 16 (FIG. 3) running around the mating surface between the upper and lower housing parts 16*a*, 16*b*.

It will be appreciated from the foregoing description of FIGS. 1 to 4 and 8, and the introductory discussion above, that the construction of housing 16 provides improved flow management beneath the crystal 3 mounted in the main or base portion of housing 16. Because of the gradual upsweep of the bottom of housing 16, water is induced to flow upwards around the bottom, thereby preventing premature separation of the flow due to the reduced pressure (produced by the Bernoulli effect) while at the same time permitting the transducer 14 to be mounted such that the housing protrudes below the boat a minimal amount. Further, the minimum frontal area, the flattened ellipsoidal nose 20, the short overall length and the radiused rear edge 67 combine to minimize the drag force acting on the boat such that no apparent power, speed or control problems have been encountered even at speeds approaching 70 mph. As discussed above, the small overall length and size of housing 16 minimizes the effective "plan area" thereof, and the shape minimizes lifting effects, and thus these improvements act together to minimize control problems. Also, the transducer can be mounted at the most favorable angle of attack for trolling (e.g., minus two to five degrees) and still perform well at any speed capability of modern boats (70 mph and more).

Figure 5:
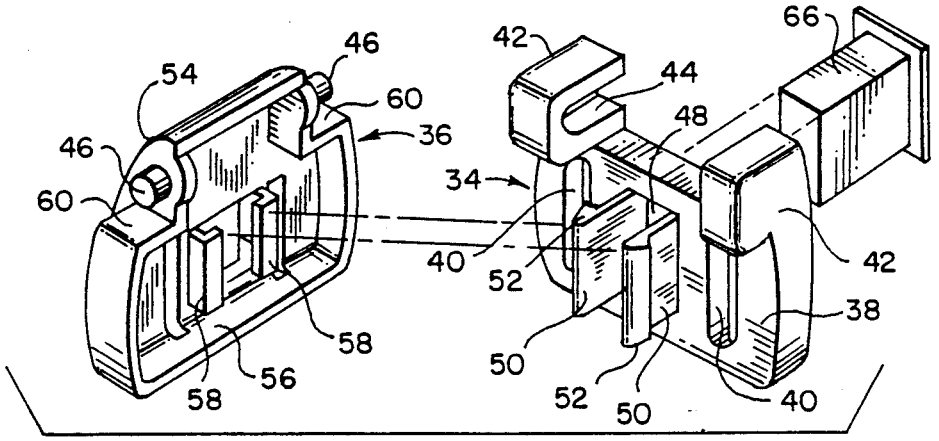
FIG. 5 is an exploded perspective view of the mounting bracket assembly of FIGS. 1 and 2.
Figure 6:
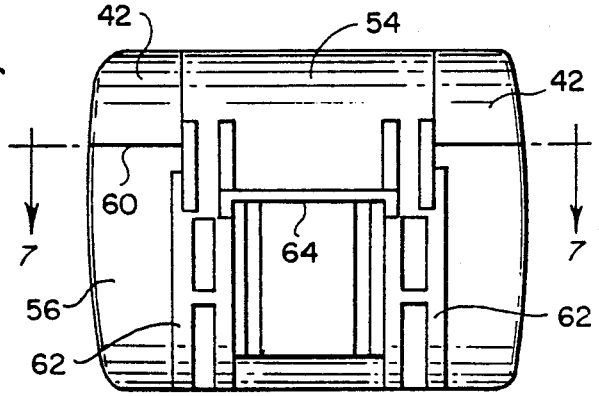
FIG. 6 is a front elevational view of the assembly of FIG. 5.
Figure 7:
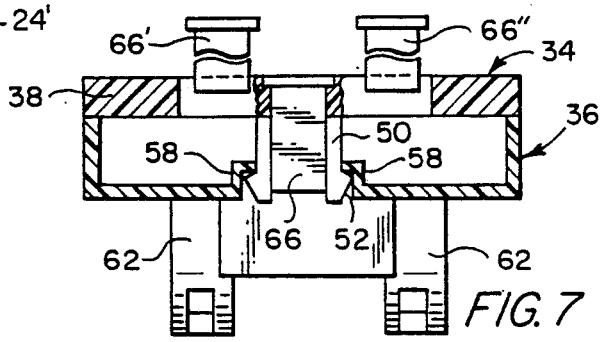
FIG. 7 is a cross sectional view taken generally along line 7—7 of FIG. 6.

Referring to FIGS. 1 and 2 together with FIGS. 5 to 7 the construction of mounting bracket assembly 12 will now be considered. As can best be seen in FIG. 5, mounting bracket assembly 12 is of three part construction and comprises two main parts, a mounting or base member 34 and a pivotable member 36 also referred to as a transducer support member.

Mounting member 34 is adapted to be affixed to the transom T of boat B as illustrated in FIGS. 1 and 2 and to this end includes a lower body portion 38 having vertically extending laterally spaced slots 40 therein through which mounting screws or like fasteners (not shown) extend so as to secure mounting member 34 in place on transom T.

A pair of upper, laterally spaced pivot mounts 42 are formed integrally with lower body portion 38 and define rearwardly opening slots 44 therein (only one of which can be seen in FIG. 4) in which oppositely extending pivot shafts 46 of pivot member 36 are received. The main body portion 38 further includes an additional opening 48 in a central area thereof and outwardly projecting connection arms 50 disposed at both sides of opening 48. Arms 50 include oppositely facing projections 52 formed along the outer upper side surfaces thereof which are in the shape of a triangle in transverse cross section (see also FIG. 7) and which act as catches or hooks in providing a snap fit with pivot member 36 as explained below.

Pivot member 36 includes a central upper body portion 54 from opposite sides of which extend the pivot shafts 46 referred to above. An integral lower body portion 56 includes a pair of spaced, vertical, rearwardly extending L-shaped projections or ears 58 which are adapted to be engaged by the corresponding projections 2 of arms 50 so as to releasably connect members 34 and 36 together.

Lower body portion 56 also includes lateral shoulders 60 which, when the two members 34 and 36 are connected together, fit under the pivot mount portions 42 of member 34 as shown in FIGS. 1 and 2.

As can best be seen in FIGS. 1, 2, 6 and 7, pivot member 36 also includes a pair of laterally spaced, rearwardly extending transducer mounting connector arms 62 between which connector portion 24 of transducer 14 is received when transducer 14 is mounted on the mounting bracket assembly 12 by means of screw 28 (FIGS. 1 and 2). A spray shield 64 extends between the connector arms 62 as shown in FIGS. 1 and 6 and serves to eliminate "rooster tails."

Members 34 and 36 are made of a relatively soft, flexible but durable material such as a relatively soft plastic and thus snap-fitting connection arms 50 of mounting member 42 and the L-shaped ears 58 are somewhat flexible or spring-like in nature. This permits the inward projections or catches 52 on arms 50 to be disengaged from ears 58 to provide a "kick-up" action when transducer 14 strikes an object in the water. Under such conditions, the spring force holding bracket members 34 and 36 is released so that the pivot member 34 can pivot out of harm's way as indicated in FIG. 2. One more important advantage of this mounting bracket assembly over most prior art transducer mounts is that the transducer 12 can be reset to exactly the same orientation or angle of attack. This is done by merely reaching into the water behind the boat and "snapping" the pivot member 36 back into place in mounting member 34 so that the transducer 14, which, of course, moves with pivot member 36, assumes its previous position, as noted above.

Figure 4:
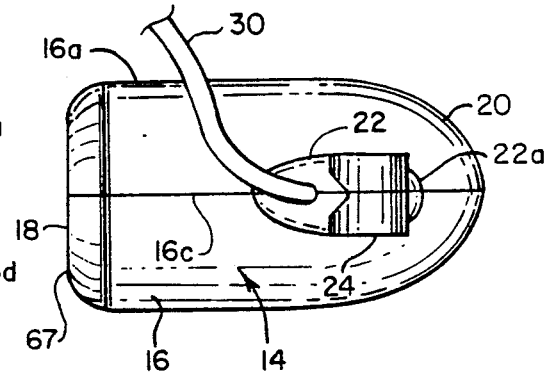

In accordance with a further important feature of the invention, the amount of spring force that must be overcome so as to provide release or "kick-up" of pivot member 36 can be controlled by means of an insert 66 shown in FIG. 4 and preferably made of rubber or the like. As indicated in FIG. 4, insert 66 fits into opening 48 between arms 50 and as can be best seen in FIG. 7 is disposed between these arms so as to control the holding force exerted by these arms, i.e., to increase the force required to provide the inward movement of these arms towards each other that is necessary to release the arms 50 from ears 58. As indicated in FIG. 7, a set of such inserts, denoted 66, 66' and 66'' may be provided, each of a different durometer, i.e., hardness or resiliency, so as to vary the stiffness of the spring force exerted and thus the force necessary to produce "kick-up." As a result, the same mounting bracket construction can be used in different applications since "kick-up" characteristic thereof can be varied by simply selecting an insert of the desired hardness. The rubber insert 66 also provides dampening of noise from the boat (e.g., the engine) as well as acoustical noise, as does the entire mounting bracket assembly 1 because of the relatively soft plastic construction thereof.

Figure 9:
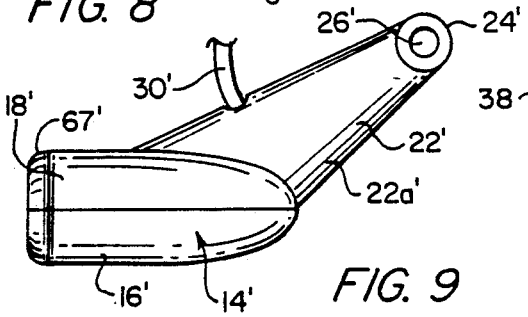
FIG. 9 is a side elevational view of a transducer constructed in accordance with a further embodiment of the invention.

Referring to FIG. 9, a further embodiment of the transducer of the invention is shown. This embodiment is similar to that of FIGS. 1 to 4 and 8, and corresponding elements have been given the same reference numerals with primes attached. The housing 16' is of the same shape as described above and the only difference between this embodiment and that described above concerns the mounting stem 22'. Mounting stem or "sail" 22' extends well forward of housing 16' and the leading edge of which, as illustrated, is attached to housing 16' at the tip of nose portion 20'. This arrangement prevents weeds or the like from collecting on the upper surface of the nose of the housing in front of mounting stem 22' such as might occur with the embodiment described previously.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A sonar transducer device adapted for attachment to the transom of a water craft so as to extend into the water, said transducer device comprising:

a shaped housing; and a piezoelectric transducer crystal mounted within said housing such that a frontal geometric projection of said transducer crystal is rectangular;

said shaped housing comprising an integral base portion and nose portion, the outer surface of said base portion being of substantially elliptical shape in transverse cross section so as to minimize the frontal cross sectional area presented to oncoming water flow while providing a smooth flow of water thereby, the major axis of the base portion of elliptical shape extending orthogonal to the longitudinal axis of the crystal, and said nose portion being of rounded tapering curvature which tapers down in cross section away from said base portion and the height of said nose portion being less than the width thereof so as to provide a smooth transition between said nose portion and said base portion of substantially elliptical shape.

2. A device as claimed in claim 1 wherein said nose portion, in longitudinal cross section, is substantially the shape of one-half of an ellipsoid.

3. A device as claimed in claim 1 wherein the end of said base portion opposite said nose portion is substantially flat apart from a radiused peripheral edge.

4. A device as claimed in claim 1 wherein said transducer device further includes a connecting member for attachment to a mounting bracket for mounting the device on the transom of the water craft, and a cable for connecting the transducer crystal to an electronics unit on the water craft, said connecting member being disposed on top of said shaped housing and the leading edge portion of said connecting member which, in use, faces upstream being faired so as to minimize the amount of disturbance to the water flowing past said leading portion, and said cable being located rearwardly of said leading edge portion of said connecting member so as to minimize the amount of disturbance to the flowing water produced by said cable.

5. A device as claimed in claim 4 wherein said leading edge portion of said connecting member is forwardly inclined and is joined to said housing substantially at the tip of said nose portion so as to reduce the likelihood of debris in the water collecting on said transducer device.

6. A device as claimed in claim 4 wherein said cord extends outwardly from a trailing portion of said connecting member which is inclined with respect to the longitudinal axis of the housing.

7. A device as claimed in claim 1 wherein said base portion defines an internal space of substantially elliptical shape in transverse cross section and wherein, as viewed in transverse cross section, the frontal geometrical projection of the transducer crystal substantially fills said internal space.

8. A device as claimed in claim 1 wherein said leading edge portion of said connecting member is angled forwardly to minimize the amount of debris from the water that is collected on the transducer device.

9. In combination, a sonar transducer device and a mounting bracket assembly for mounting the transducer device on the transom of a water craft so that, in use, said transducer device extends into the water, said transducer device comprising:

a shaped housing; and a piezoelectric transducer crystal mounted within said housing such that a frontal geometric projection of said transducer crystal is rectangular;

said shaped housing comprising an integral base portion and nose portion, the outer surface of said base portion being of substantially elliptical shape in transverse cross section, so as to, in use, minimize the frontal cross sectional area presented to oncoming water flow while providing smooth flow of water thereby, the major axis of the base portion of substantially elliptical shape extending orthogonal to the longitudinal axis of the crystal and the shape of said nose portion being substantially that of one-half of an ellipsoid in longitudinal cross section and having a height less than the width thereof so as to provide a smooth transition between said nose portion and said base portion of substantially elliptical shape.

10. A combination as claimed in 9 wherein said transducer device further includes a connecting member for attachment to a mounting bracket for mounting the device on the transom of the water craft, and a cable for connecting the transducer crystal to an electronics unit on the water craft, said connecting member being disposed on top of said shaped housing and the leading edge portion of said connecting member which, in use, faces upstream being faired so as to minimize the amount of disturbance to the water flowing past said leading portion, and said cable being located rearwardly of said leading edge portion of said connecting member so as to minimize the amount of disturbance to the flowing water produced by said cable.

11. A combination as claimed in claim 9 wherein the leading edge portion of said connecting member is joined to said housing substantially at the tip of said nose portion and said cord extends rearwardly from a trailing portion of said connecting member.

12. A combination as claimed in claim 9 wherein said mounting bracket assembly comprises a pair of members molded of soft plastic and releasably connected together so as to permit relative pivoting movement of said members, one of said members being adapted to be mounted on the transom of a boat and the other of said members being connected to said transducer device and pivotably connected to the one member so as to enable pivoting of said transducer device out of harm's way.

13. A combination as claimed in claim 9 wherein said mounting assembly comprises a base member adapted to be secured to the transom of the water craft; a transducer support member connected to the transducer device; and means for pivotably mounting said support member on said base member so as to permit pivoting of said support member from a first, operative position wherein said support member and said base member are in engagement and said transducer device is supported in a predetermined position, and a second, inoperative position wherein said support member is pivoted away from said base member; said members including releasable connection means for releasably connecting said members together in said operative position such that when said support member is pivoted to said second position the support member can be returned by a user to said operative position so as to return the transducer device to said predetermined position, said connection means comprising a pair of spaced, projecting arms formed on one of said members and defining a space between said arms and a spaced pair of engagement members formed on the other of said members with which said arms are respectively engaged in said operative position of said support member, said arms, when in engagement with said engagement members, being biased so as to exert retaining forces acting in opposed directions and said arms being caused to move towards each other against said forces in order to provide release of said connection means, and said connection means further including a resilient member disposed in the space between said arms so as to control the size of the forces necessary to cause movement of said arms towards each other to provide release of said connecting means.

14. A combination as claimed in claim 13 wherein said assembly includes a plurality of resilient members of different resiliency which can be selectively disposed between said arms to control the size of the forces necessary to cause said movement of said arms towards each other.

15. A combination as claimed in claim 9 wherein said base portion defines an internal space of substantially elliptical shape in transverse cross section and wherein, as viewed in transverse cross section, the frontal geometrical projection of the transducer crystal substantially fills said internal space.

16. A combination as claimed in claim 9 wherein said leading edge portion of said connecting member is angled forwardly to minimize the amount of debris from the water that is collected on the transducer device.

17. A combination as claimed in claim 9 wherein said mounting bracket assembly comprises a single shaft for connecting said transducer device to said assembly so as to permit said device to freely rotate about said shaft.

18. A mounting bracket assembly for mounting a transducer on a transom of a water craft, said mounting assembly comprising:

a base member adapted to be secured to the transom of the water craft;

a transducer support member adapted to be connected to the transducer;

means for pivotably mounting said support member on said base member so as to permit pivoting of said support member from a first, operative position wherein said support member and said base member are in engagement and a transducer connected to the support member is supported in a predetermined position, and a second, inoperative position wherein said support member is pivoted away from said base member; said members including releasable connection means for releasably connecting said members together in said operative position such that when said support member is pivoted to said second position the support member can be returned by a user to said operative position so as to return a transducer connected to said support member to said predetermined position, said connection means comprising a pair of spaced, projecting arms formed on one of said members and a spaced pair of engagement members formed on the other of said members with which said arms are respectively engaged in said operative position of said support member, said arms defining a space therebetween, said arms, when in engagement with said engagement members, being biased so as to exert retaining forces acting in opposed directions, and said arms being caused to move towards each other against said forces in order to provide release of said connection means, and said connection means further including a resilient member disposed in the space between said arms so as to control the size of the forces necessary to cause movement of said arms towards each other to provide release of said connecting means.

19. A mounting bracket assembly as claimed in claim 18 wherein said engagement members comprise L-shaped members and said retaining means comprise projections at the free ends of said arms which engage the ends of said L-shaped members.

20. A mounting bracket assembly as claimed in claim 18 wherein said assembly includes a plurality of resilient members of different resiliency which can be selectively disposed between said arms to control the size of the forces necessary to cause said movement of said arms towards each other.

21. A combination as claimed in claim 18 wherein said mounting bracket assembly comprises a single shaft for connecting said transducer device to said assembly so as to permit said device to freely rotate about said shaft.

* * * * *